US006855895B2

(12) United States Patent
Santa Cruz et al.

(10) Patent No.: US 6,855,895 B2
(45) Date of Patent: Feb. 15, 2005

(54) ELECTRICAL LOCKOUT LANYARD AND METHOD FOR ASSEMBLY AND INSTALLATION

(76) Inventors: Cathy D. Santa Cruz, 7630 Tholl Dr., Reno, NV (US) 89506; James A. Hertz, 5630 Sun Valley Blvd. #35, Sun Valley, NV (US) 89433

( * ) Notice: Subject to any disclaimer, the term of this patent is extended or adjusted under 35 U.S.C. 154(b) by 0 days.

(21) Appl. No.: 10/870,380

(22) Filed: Jun. 16, 2004

(65) Prior Publication Data

US 2004/0251116 A1 Dec. 16, 2004

Related U.S. Application Data

(60) Provisional application No. 60/478,406, filed on Jun. 16, 2003.

(51) Int. Cl.[7] ..... H01H 9/28

(52) U.S. Cl. ..... 200/43.11; 200/43.14; 200/43.16

(58) Field of Search ..... 200/43.11–43.22

(56) References Cited

U.S. PATENT DOCUMENTS

| | | | | | |
|---|---|---|---|---|---|
| 4,195,192 | A | * | 3/1980 | Hackney et al. | 174/40 R |
| 4,806,710 | A | * | 2/1989 | Kalvaitis et al. | 200/50.12 |
| 5,293,011 | A | * | 3/1994 | Mokert | 200/43.14 |
| 5,412,167 | A | * | 5/1995 | Mueller et al. | 200/43.14 |
| 5,432,308 | A | * | 7/1995 | Howie, Jr. | 200/43.14 |
| 5,772,007 | A | * | 6/1998 | Frye | 200/43.14 |

* cited by examiner

*Primary Examiner*—Kyung Lee

(57) ABSTRACT

A lanyard that is of simple construction and is made from insulated components so as to eliminate any possibility of accidental electrical shock. The lanyard when in the off mode insures that the on/off switch of an overhead disconnect outlet box cannot be accidentally moved into the on position, and when in the on mode insures that the on/off switch remains in operating position, thus allowing for electrical current for energizing machinery, unless there is a power failure.

5 Claims, 3 Drawing Sheets

FIG. 2-A

ELECTRICAL LOCKOUT LANYARD AND METHOD FOR ASSEMBLY AND INSTALLATION

RELATED PRIOR ART

This application is derived from our provisional application No. 60/478,406 filed on Jun. 16, 2003 and is now hereby to be converted to a full Utility patent as follows:

FIELD OF THE INVENTION

The lanyard of the present invention relates in general to electrical shut-off means typically associated with industrial machinery and which allows a workman to easily shut off electrical current to the machine for safety purposes during servicing or repairs. However, the present lanyard more particularly pertains to an accessory device that can be easily installed on site and fixedly attached onto a typical on/off switch associated with an overhead electrical switch box. The lanyard is of simple construction and is made from insulated components so as to eliminate any possibility of accidental electrical shock. The lanyard when in the off mode insures that the on/off switch cannot be accidentally moved into the on position, and when in the on mode insures that the on/off switch remains in operating position, thus allowing for electrical current for energizing machinery, unless there is a power failure.

BACKGROUND OF THE INVENTION

Switches are used in many applications to control the flow of electrical energy. The switches can be used to redirect electrical energy from one circuit to another, and can be used to stop the flow of electrical energy through a circuit. In both cases the circuits become de-energized, that is without a voltage. One particular type of switch is a circuit breaker which cuts off the flow of electrical energy when the flow of electrical energy through the switch exceeds a predetermined value. Many of these circuit breakers include a lever which is movable between an "On" position and an "Off" position.

Maintenance personnel often use a circuit breaker to cut the flow of electrical energy through a circuit when the circuit, or electrical components connected thereto, require maintenance. The circuit breaker, however, is often remote from the location requiring maintenance. Therefore, it is desirable to lock out the circuit breaker to prevent an individual from inadvertently energizing the circuit while maintenance is being performed.

Known circuit breaker lock out assemblies engage the circuit breaker lever to prevent unauthorized movement of the lever. Lockouts such as disclosed in U.S. Pat. Nos. 5,593,020; 5,794,760, and 5,900,600, include a lock arm cantilevered from a lock rail. The lock arm includes a head that engages or covers the circuit breaker lever to prevent unauthorized movement of the lever. The lock out devices as taught within the cited references, can easily be circumvented by lifting the cantilevered head away from the lever and thus disengaging the lever from the head. As a result, the lock out adequately serves to provide notice to an individual that movement of the lever is unauthorized, however, it is not always effective to prevent unauthorized lever movement.

Another disadvantage of the prior art cantilevered lock out device is the inability to lock out adjacent circuit breakers aligned along an axis perpendicular to the lock rail. Only one opening in the lock rail can be used to hold a cantilevered lock arm, and each lock arm can lock out only one circuit breaker. In addition, the prior art cantilevered lock out assemblies disclosed in the above referenced patents, are very complicated and use numerous parts that the present invention clearly eliminates.

Another type of an electrical lockout device is taught within U.S. Pat. No. 5,451,730 entitled "ELECTRICAL SAFETY APPARATUS" which substantially teaches an elongated insulated rod having an upper disconnect hook to engage a handle of a switch box. This apparatus is functional for its intended use but still has inherent disadvantages and drawbacks that the present invention recognizes, addresses and resolves in a manner not heretofore taught. For example, this type of lockout apparatus does not provide a suitable locking mechanism such as a typical pad lock, and due to strict regulations it is unlikely this apparatus would be allowed or approved. The locking mechanism is simply a curved bar which is held in a locked position by a tension spring. Thus, use of a spring is not effective as springs tend to easily wear out and the tension is variable which is most unfortunate as this results in an inefficient locking mechanism.

One of the most important drawbacks of the known prior art is the fact that the workman must be within arms reach of the electrical disconnect box so as to be able to shut the switch off and then attach a pad lock. This is very important as "Osha" regulations are very clear and precisely state that a pad lock or the like must be incorporated for a safe and secure lockout. This can be very difficult because most industrial facilities have pallets, crates, materials and other obstacles between the affected machines. Thus, such items must be removed and/or re-positioned so as to allow the workman access to the electrical disconnect box. This not only results in increased cost and loss of valuable time but is also dangerous for the workman as they must further climb onto a step ladder or the like to obtain proper height for attaching the pad lock.

It is therefore contended that a need exists for a new and improved type of lockout device that may be used for disconnecting overhead electrical switches and which eliminates the inherent drawbacks and disadvantages of the known prior art. It is further contended that such a lockout device should be durable, safe, easy to use and inexpensive to manufacture. It is also important to provide simple assembly and installation instructions, such as taught within the forthcoming specifications.

SUMMARY OF THE INVENTION

It is therefore a primary object of the present invention to provide an electrical lockout lanyard that allows a workman to easily shut off an overhead electrical disconnect box without the need to physically attach a pad lock directly onto the box.

It is another object of the present invention to provide an electrical lockout lanyard that may be easily installed and assembled on site without the need for any specialized skills or tools.

Yet another object of the present invention is to provide an electrical lockout lanyard that is adaptable for use on site as it is not limited to any specific length and is easily adjusted for ultimate performance by the workman upon installation.

Still another object of the present invention is to provide an electrical lockout lanyard that does not require any modifications of either the disconnect box or the machinery associated therewith.

A further object of the present invention is to provide an electrical lockout lanyard that once installed is permanent and then only used if needed. This is important, as if there is a need to quickly shut the off the power, the lanyard is easily accessible and provides instantaneous shut off. This is very different than the noted prior art that is very time consuming to use and does not allow for fast and easy access.

Yet another object of the present invention is to provide an electrical lockout lanyard that is of very simple construction, and is made from all insulated materials so as to eliminate any accidental electrocution.

It is a very important object to provide an electrical lockout lanyard that is approved for use by "Osha" and meets all requirements and regulations. In fact it may perhaps become mandatory, as it is a life saving device and it is much more desirable and advanced than the known prior art.

Another important object of the present invention is to provide an electrical lockout lanyard that is made from inexpensive materials so as to be cost effective for manufacture, sales and marketing.

Still a further object of the present invention is to provide an electrical lockout lanyard that may be sold and produced as a kit having all the necessary components for installation and instructions for assembly included therewith.

Yet a further object of the present invention is to provide a method of use as taught within the forthcoming specifications.

Other objects and advantages will be seen when taken into consideration with the following specification and drawings.

DETAILED DESCRIPTION OF THE DRAWINGS

Figure 1:
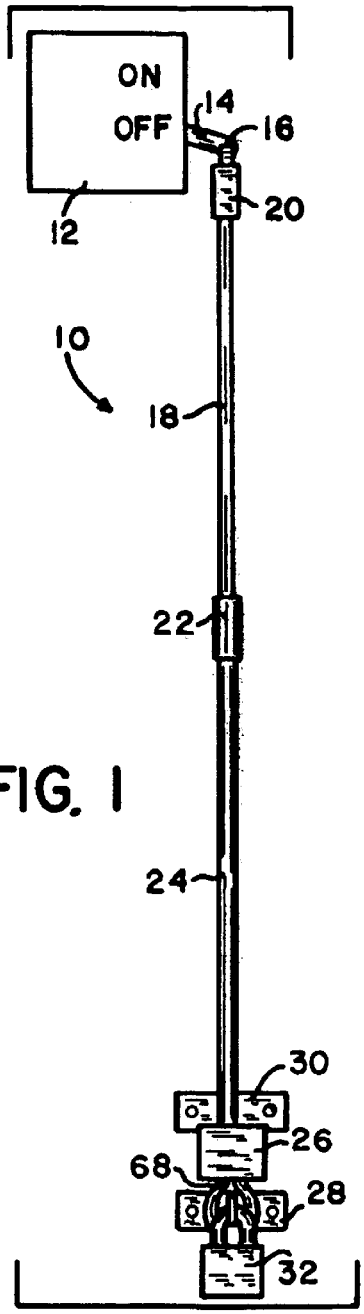
FIG. 1 is substantially a plan view for the present invention when installed and secured in a locked "off" position.

Referring now in detail to the drawings wherein like elements pertain to like characters throughout the various views. The present invention is substantially a universal electrical lockout lanyard (10) for use in combination with a typical overhead electrical disconnect switch (12) for positively shutting off electrical current there from for maintenance, repairs or the like.

Overhead electrical disconnect switch (12) is of the prior art standard type having a lever (14) which when in the "on" position allows electrical current to flow there from and when in the "off" position does not allow electrical current to flow. This standard type of electrical disconnect further includes a locking latch mechanism (16) which is of a shape and size to receive a pad lock (not shown) therein and is used for locking lever (14) into either the "on" or "off" position.

It is to be noted different embodiments may easily be conceived for the present invention, such as electrical lockout lanyard (10) may simply be formed from one elongated insulated member having a locking apparatus on each of its ends, whereby one end thereof is fixedly attached onto the locking latch mechanism (16) and the opposing end is removably affixed onto a first pad lock receiving latch (28) and then locked into position with a pad lock (32) with the latter latch being located at a position of workman's choice. Whereby, when lever (14) is in the off position and the opposing end is locked onto first pad lock receiving latch (28) electricity is positively shut off and lever (14) cannot be moved into the "on" position until the pad lock (32) has been removed.

Thereafter, when the technician desires to return lever (14) into the its operating "or" position, they must first remove the lock (32) and then re-position the opposing end onto a second pad lock receiving latch (30), attach pad lock (32) onto second pad lock receiving latch (30) and then return the lever (14) back into its operating "on" position which automatically restores electrical power.

The preferred embodiment as taught herein includes electrical lockout lanyard (10) being of simple construction and when assembled substantially comprises a first elongated cable section (18) having a first end (18-A) and a second end (18-B). First end (18-A) being threadably affixed and secured within a first clamp lock member (20) and second end (18-B) being threadably affixed and secured within a coupling member (22). A second elongated cable section (24) having a first end (24-A) and a second end (24-B). First end (24-A) being threadably affixed and secured within a second clamp lock member (26) and second end (26-B) being threadably affixed and secured within coupling member (22).

It is to be understood each of the cable sections (18 & 24), clamp lock members (20 & 26), and coupling member (22) can be made from any suitable material of engineering choice, such as plastic or Nylon™ etc., thus the following is only exemplary of some possible materials of choice. However, after extensive research and evaluation of cost and manufacturing, it has been determined that the preferred embodiment incorporates the following materials and construction method of choice.

As taught herein, first cable section (18) is made from a plastic vinyl cable having an outside diameter of 0.155 respectively. Second cable section (24) is made from a vinyl coated steel wire rope having an outside diameter of 0.250, respectively and clamp lock members (20 & 26) and coupling member (22) are each made from Delrin™ material.

It is to be further understood the electrical lockout lanyard (10) may be manufactured and sold as a kit, wherein the above noted components are provided yet the kit further includes 12-10/32×3/8" set screws, 1–0.155 thimble, 1–0.250 thimble and full assembly instructions, each of which are herein latter described.

Figure 3:
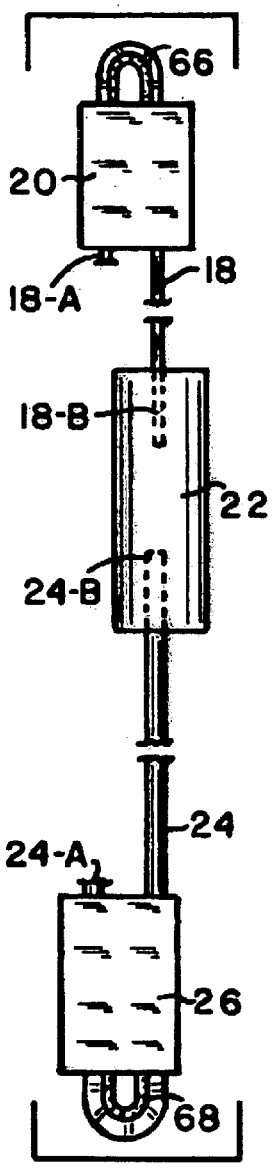
FIG. 3 is substantially a front view of first clamp lock member.
Figure 3:
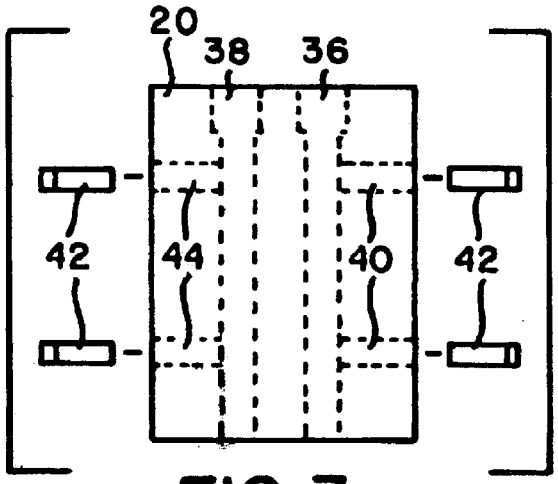

Referring now to the actual construction of each of the noted components. As depicted in FIG. 3, first clamp lock member (20) is substantially in the shape of a solid block. Thus first clamp lock member (20), includes a topside, a bottom side, a front side, a rear side, a right side, and a left side. Clamp lock member (20) having a first elongated internal bore (36) and a second elongated internal bore (38) and each bore (36 & 38) are in parallel vertical alignment with each other. Each bore (36 & 38) providing open communication between the noted topside and bottom side. Each bore (36 & 38) when measured from the bottom side have a diameter that is less than when measured from the topside and each bore (36 & 38) are of a shape and size to threadably receive first cable section (18) therein. However, the larger sized end of bores (36 & 38) is enlarged so as allow space for not only first cable section (18) but also to receive in combination both ends of a first inverted U-shaped thimble (66) therein. The right side of first clamp lock member (20) further includes a pair of internal horizontal spaced apart bores (40) that are in parallel alignment with each other. Bores (40) being in open communication with first elongated internal bore (36) and each of bores (40) are of a shape and size to threadably receive and retain a 10/32×3/8" set screw (42) therein. The left side of first clamp lock member (20) further includes a pair of internal horizontal spaced apart bores (44) that are in parallel alignment with each other. Bores (44) being in open communication with second elongated internal bore (38) and each of bores (44) are of a shape and size to threadably receive and retain a 10/32×3/8" Hex head set screw (42) therein.

Figure 5:
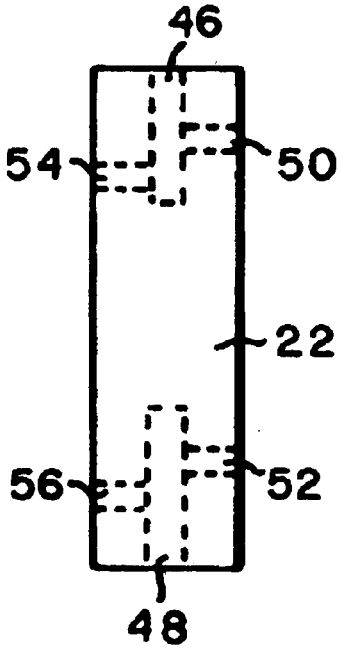
FIG. 5 is substantially a front view of a coupling member.

As depicted in FIG. 5, coupling member (22) is substantially in the shape of an elongated solid circular member. Thus coupling member (22) includes a topside, a bottom side, a front side, a rear side, a right side, and a left side, respectively. Topside of coupling member (22) having an internal vertical bore (46) which is of a shape and size to threadably receive the second end (18-B) of first cable section (18) therein. Bottom side of coupling member (22) having an internal vertical bore (48) which is of a shape and size to threadably receive the second end (24-B) of second cable section (18) therein. Internal vertical bores (46 & 48) being opposed to each other in vertical alignment but they are not in open communication with each other and bore (48) being larger in diameter than bore (46). Right side of coupling member (22) having a first horizontal bore (50) which is in open communication with internal vertical bore (46), and a second horizontal bore (52) which is in open communication with internal vertical bore (48). Left side of coupling member (22) having a first horizontal bore (54) which is in open communication with internal vertical bore (46), and a second horizontal bore (56) which is in open communication with internal vertical bore (48). Also, bores (50–56) are each of a shape and size to size to threadably receive and retain a 10/32×3/8" Hex head set screw (42) therein.

Figure 4:
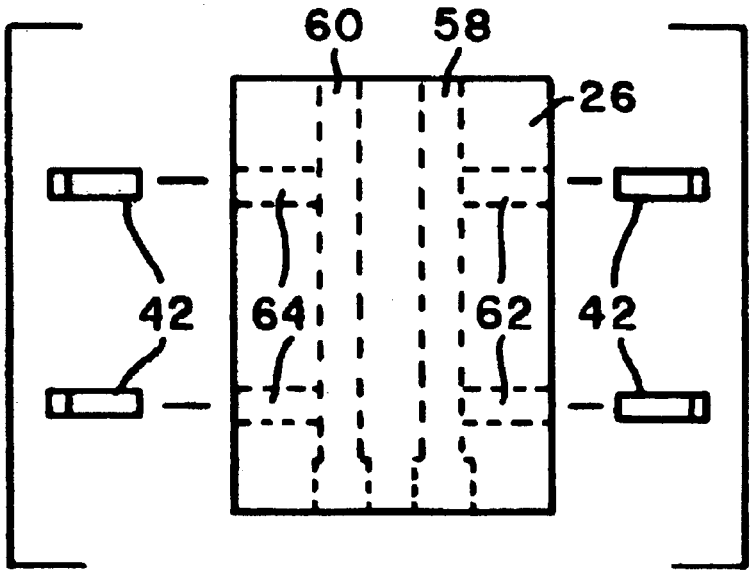
FIG. 4 is substantially a front view of a second clamp lock member.

Referring now to FIG. 4, wherein second clamp lock member (26) is substantially in the shape of a solid block. Thus second clamp lock member (26), includes a topside, a bottom side, a front side, a rear side, a right side, and a left side. Second clamp lock member (26) having a first elongated internal bore (58) and a second elongated internal bore (60) and each bore (58 & 60) are in parallel vertical alignment with each other. Each bore (58 & 60) providing open communication between the noted topside and bottom side. Each bore (58 & 60) when measured from the bottom side have a diameter that is more than when measured from the topside and each bore (58 & 60) are of a shape and size to threadably receive second cable section (24) therein. However, the larger sized end of bores (58 & 60) is enlarged so as allow space for not only second cable section (24) but also to receive in combination both ends of a second U-shaped thimble (68) therein. The right side of second clamp lock member (26) further includes a pair of internal horizontal spaced apart bores (62) that are in parallel alignment with each other. Bores (62) being in open communication with first elongated internal bore (58) and each of bores (62) are of a shape and size to threadably receive and retain a 10/32×3/8" set screw (42) therein. The left side of second clamp lock member (26) further includes a pair of internal horizontal spaced apart bores (64) that are in parallel alignment with each other. Bores (64) being in open communication with second elongated internal bore (60) and each of bores (64) are of a shape and size to threadably receive and retain a 10/32×3/8" Hex head set screw (42) therein.

Figure 2:
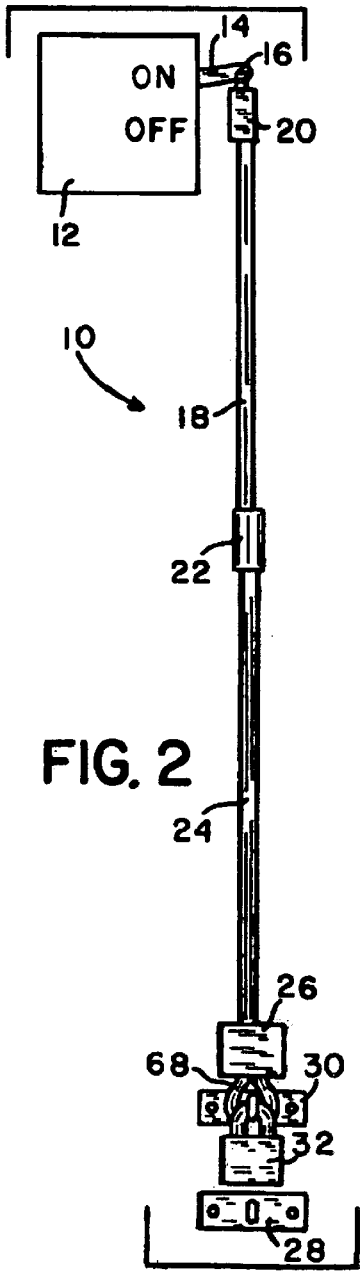
FIG. 2 is substantially a plan view for the present invention when installed and secured in a locked "on" position.

For further clarification and as depicted in FIG. 2, it can clearly be seen that first clamp lock member (20), first cable section (18) and first inverted U-shaped thimble (66) in combination form substantially a first padlock when assembled and second clamp lock member (26), second cable section (24) and second U-shaped thimble (68) in combination form substantially a second padlock when assembled. Thus, first padlock and second padlock are interconnected via coupling block member (22).

It is to be noted additional options maybe included depending on engineering and consumer needs. For example, second clamp lock member (26) may be color-coded having its front side colored green and its backside colored red. It is to be noted the color-coding can either be embedded as part of the manufacturing process or it may be in the form of removable adhesive stickers or tags, etc. Whereby, when a workman is currently working on the machine he would display the red side, this in turn visually notifies people in the surrounding area that they must not turn on the power or the machinery. However, the green side is to be displayed when the workman has finished the job and power has been restored, thus notifying people in the surrounding area that all is in operating order and they may operate the machinery. Another option may be to include identification or advertisement labels having pertinent information thereon pertaining to either the device itself, the company of manufacture, or the company using the product, etc.

As previously noted, we will now address the actual assembly and installation method. The following method steps are for assembly and installation of an electrical lockout lanyard which is an accessory device that can be easily installed on site and fixedly attached onto a typical on/off switch associated with an overhead electrical switch box and allows a workman to easily either shut the power off or on. The lanyard (10) may simply be formed from one elongated insulated member having a first locking apparatus and a second locking apparatus, whereby one end thereof is fixedly attached onto the locking latch mechanism (16) on an overhead disconnect box and the opposing end is removably affixed onto a first pad lock receiving latch (28) and then locked into position with a pad lock (32) with the latter latch being located at a position of workman's choice. Whereby, when lever (14) is in the off position and the opposing end is locked onto first pad lock receiving latch (28) electricity is positively shut off and lever (14) cannot be moved into the "on" position until the pad lock (32) has been removed. The method steps comprising:

a. locating an overhead disconnect box (12) having an on/off lever (14) with a locking latch mechanism (16) thereon;

b. positioning lever (14) into an "off" position;

c. attaching a first locking apparatus (20) onto locking latch mechanism (16);

d. determining a location of choice for positioning the second locking apparatus (26) when it is to be in the "off" position;

e. installing a first pad lock receiving latch (28) at the desired location of choice;

f. determining a location of choice for positioning the second locking apparatus (26) when it is to be in the "on" position;

g. installing a second pad lock receiving latch (30) at the last noted desired location of choice;

h. attaching the second locking apparatus (26) onto first pad lock receiving latch (28);

i. attaching a pad lock (32) onto second locking apparatus (26) and first pad lock receiving latch (28), whereby on/off lever (14) is now locked into the off position and power cannot be restored until unlocked;

j. performing a task upon the machinery that is disconnected, thereafter restoring power to the machinery in the following manner;

k. unlocking and removing pad lock (32);

l. removing second locking apparatus (26);

m. attaching second locking apparatus (26) onto second pad lock receiving latch (30);

n. attaching a pad lock (32) onto second locking apparatus (26) and second pad lock receiving latch (30); and o. positioning lever (14) into an "on" position, whereby on/off lever (14) is now locked into the "on" position and power is now restored.

For further clarification, the above method steps also include the following assembly steps to be performed prior to step "a" above, comprising:

a. inserting set screws (42) approximately three turns into each respective threaded hole (50, 52, 54 & 56) of coupling block member (22);

b. marking with an ink pen on one end of first cable section (18) a mark which is 1¼ inches from the selected end;

c. marking with an ink pen on one end of second cable section (24) a mark which is 1¼ inches from the selected end;

d. grasping a coupling block member (22), with coupling block member having a first bore (46) that is of a shape and size to threadably receive the marked end (18-B) of first cable section (18), and a second bore (48) that is of a shape and size to threadably receive the marked end (24-B) of second cable section (24);

e. inserting marked end (18-A) into first bore (46) until mark is flush with coupling block member (22);

f. tightening each set screw within bores (50 & 54), approximately 1½ turns past flush;

g. inserting marked end (24-B) into second bore (48) until mark is flush with coupling block member (22); and h. tightening each set screw within bores (52 & 56), approximately 1½ turns past flush; whereby each cable section (18 & 24) are interconnected by coupling block member (22).

For still further clarification, the first method steps (a–o) above further include the following assembly steps that are used for attaching the first locking apparatus (20) onto locking latch mechanism (16), (see step "c") comprising of the following steps;

a. measuring and marking a reference point between 36" and 48" vertically below overhead disconnect box (12) which will be the desired position for coupling block member (22) when it is to be in the "off" position;

b. inserting first end (18-A) of first cable section (18) upwardly into first bore (36) of first locking apparatus (20) until it extends approximately 6 inches there from;

c. inserting first end (18-A) into and throughout a hole located on on/off lever (14) of locking latch mechanism (16);

d. inserting first end (18-B) downwardly into and throughout second bore (38) of first locking apparatus (20);

e. adjusting first cable section (18) until coupling block member (22) is positioned at the marked reference point;

f. tightening set screws (42) located in bores (40) until one turn past flush within first locking apparatus (20);

g. pulling downwardly on first end (18-A) until a small loop is formed;

h. inserting a downwardly an inverted U-shaped thimble (66) into bores (36 & 38);

i. pulling downwardly on first end (18-A) until the loop mates onto inverted U-shaped thimble (66) in a firm manner;

j. tightening set screws (42) located in bores (44) until one turn past flush within first locking apparatus (20); and k. cutting off first end (18-A) so as to allow first cable section to have a flush fit therein; whereby the first locking apparatus (20) is now locked onto locking latch mechanism (16).

For still further clarification, the first method steps (a–o) above further include the following assembly steps that are used for determining the location of choice for second locking apparatus (26) when it is to in the "off" position, comprising the assembly steps as follows:

a. measuring and marking a reference point that is approximately 7 ft. 6 inches vertically above ground level, this will be the desired position for second locking apparatus (26) when it is to be in the "off" position;

b. inserting first end (24-A) of first second cable section (24) downwardly into first bore (58) of second locking apparatus (26) until it extends approximately 6 inches there from;

c. inserting first end (24-B) upwardly into and throughout second bore (60) of second locking apparatus (26);

d. adjusting second cable section (24) until second locking apparatus (26) is positioned at the last noted marked reference point;

e. tightening set screws (42) located in bores (62) until one turn past flush within second locking apparatus (26);

f. pulling upwardly on first end (24-A) until a small loop is formed;

g. inserting upwardly a U-shaped thimble (68) into bores (58 & 60);

h. pulling upwardly on fist end (24-A) until the loop mates onto U-shaped thimble (68) in a firm manner;

i. tightening set screws (42) located in bores (64) until one turn past flush within second locking apparatus (26); and j. cutting off first end (24-A) so as to allow second cable section (24) to have a flush fit therein; whereby the second locking apparatus (26) can now be locked onto either the first or second pad lock receiving latch (28 or 30).

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by Letters Patent is:

1. A universal electrical lockout lanyard for use in combination with a prior art overhead electrical disconnect switch, said prior art overhead electrical disconnect switch having a lever, said lever having an on position and an off position, said lever having a locking latch mechanism which is used for locking said lever into either said on position or said off position, said universal electrical lockout lanyard comprising: an elongated insulated member; a first clamp lock member; a second clamp lock member; a first pad lock receiving latch; a second pad lock receiving latch; and a pad lock; said elongated insulated member having a first end and a second end, said first end having said first clamp lock member fixedly attached thereon, said second end having said second clamp lock member fixedly attached thereon, said first clamp lock member being fixedly attached onto said locking latch mechanism of said lever, and said second clamp lock member being removably attachable onto either said first pad lock receiving latch or said second pad lock receiving latch, whereby:

when said lever assumes said off position and said second clamp lock member is attached onto said first pad lock receiving latch and affixed in place by said pad lock, said lever is positively locked and cannot be moved into said on position.

2. The universal electrical lockout lanyard of claim 1 further comprising; said elongated insulated member when constructed and assembled is formed from a first elongated cable section; a second elongated cable section; and a coupling member; said first elongated cable section having a first end and a second end, said first end of said first elongated cable section being threadably affixed and secured within said first clamp lock member, said second end of said first elongated cable section being threadably affixed and secured within said coupling member, said second elongated cable section having a first end and a second end, said first end of said second elongated cable section being threadably affixed and secured within said second clamp lock member, and said second end of said second elongated cable section being threadably affixed and secured within said coupling member.

3. The universal electrical lockout lanyard of claim 2 wherein said first clamp lock member is further formed in the shape of a solid block having a top side, a bottom side, a front side, a rear side, a right side, a left side, a first elongated internal bore, a second elongated internal bore, each said bore being in parallel vertical alignment with each other, each said bore providing open communication between said topside and said bottom side, each said bore when measured from said bottom side have a diameter that is less than when measured from said topside thus forming larger sized ends for each said bore, each said bore being of a shape and size to threadably receive said first cable section therein, however said larger sized ends for each said bore allow space for not only said first cable section but also provide space to receive in combination both ends of a first inverted U-shaped thimble therein, said right side of said first clamp lock member further having a pair of internal horizontal spaced apart bores that are in parallel alignment with each other, last said bores being in open communication with said first elongated internal bore, last said bores being of a shape and size to receive and retain a fastener therein, said left side of said first clamp lock member further having a pair of internal horizontal spaced apart bores that are in parallel alignment with each other, last said bores being in open communication with said second elongated internal bore and each of last said bores are of a shape and size to receive and retain a fastener therein, said coupling member being in the shape of an elongated solid circular member having a topside, a bottom side, a front side, a rear side, a right side, and a left side, said topside of said coupling member having a first internal vertical bore which is of a shape and size to receive said second end of said first cable section therein, said bottom side of coupling member having a second internal vertical bore which is of a shape and size to receive said second end of said second cable section therein, said first internal vertical bore and said second vertical internal bore being opposed to each other in vertical alignment but not in open communication with each other, said second internal vertical bore being larger in diameter than said first internal vertical bore, said right side of said coupling member having a first horizontal bore which is in open communication with said first internal vertical bore, said right side of said coupling member having a second horizontal bore which is in open communication with said second internal vertical bore, said left side of said coupling member having a first horizontal bore which is in open communication with said first internal vertical bore, said left side of said coupling member having a second horizontal bore which is in open communication with said second internal vertical bore, said first horizontal bore of said right side and said second horizontal bore of said left side each being of a shape and size to receive and retain a fastener therein, said second clamp lock member is further formed in the shape of a solid block having a top side, a bottom side, a front side, a rear side, a right side, a left side, a first elongated internal bore, a second elongated internal bore, each said bore being in parallel vertical alignment with each other, each said bore providing open communication between said topside and said bottom side, each said bore when measured from said bottom side have a diameter that is more than when measured from said topside thus forming larger sized ends for each said bore, each said bore being of a shape and size to threadably receive said second cable section therein, however said larger sized ends for each said bore allow space for not only said second cable section but also provide space to receive in combination both ends of a second U-shaped thimble therein, said right side of said second clamp lock member further having a pair of internal horizontal spaced apart bores that are in parallel alignment with each other, last said bores being in open communication with said first elongated internal bore of said second clamp lock member, last said bores being of a shape and size to receive and retain a fastener therein, said left side of said second clamp lock member further having a pair of internal horizontal spaced apart bores that are in parallel alignment with each other, last said bores being in open communication with said second elongated internal bore and each of last said bores are of a shape and size to receive and retain a fastener therein.

4. The universal electrical lockout lanyard of claim 3 wherein said first clamp lock member, said first cable section, and said first inverted U-shaped thimble in combination form a first padlock when assembled, said second clamp lock member, said second cable section, and said second U-shaped thimble in combination form a second padlock when assembled, thus said first padlock and said second padlock are interconnected via said coupling block member.

5. A method of use and installation for a universal electrical lockout lanyard comprising the steps of:

a. locating an overhead disconnect box (12) having an on/off lever (14) with a locking latch mechanism (16) thereon;

b. positioning said on/off lever (14) into an "off" position;

c. attaching a first locking apparatus (20) onto said locking latch mechanism (16);

d. determining a location of choice for positioning a second locking apparatus (26) when it is to be in said "off" position;

e. installing a first pad lock receiving latch (28) at said location of choice;

f. determining a location of choice for positioning said second locking apparatus (26) when it is to be in an "on" position;

g. installing a second pad lock receiving latch (30) at last said location of choice;

h. attaching said second locking apparatus (26) onto said first pad lock receiving latch (28);

i. attaching a pad lock (32) onto said second locking apparatus (26) and said first pad lock receiving latch (28), whereby said on/off lever (14) is now locked into said off position and power cannot be restored until unlocked;

j. performing a task upon machinery that is disconnected, thereafter restoring power to said machinery in the following manner, k. unlocking and removing said pad lock (32);

l. removing said second locking apparatus (26);

m. attaching said second locking apparatus (26) onto said second pad lock receiving latch (30);

n. attaching said pad lock (32) onto said second locking apparatus (26) and said second pad lock receiving latch (30); and o. positioning said lever (14) into said "on" position, whereby said on/off lever (14) is now locked into said "on" position and power is now restored.

* * * * *